United States Patent [19]

Salto

[11] 4,027,763

[45] June 7, 1977

[54] KEYBOARD FOR OFFICE MACHINES

[75] Inventor: Rinaldo Salto, Ivrea (Turin), Italy

[73] Assignee: Ing. C. Olivetti & C., S.p.A., Ivrea (Turin), Italy

[22] Filed: Aug. 2, 1976

[21] Appl. No.: 710,671

Related U.S. Application Data

[63] Continuation of Ser. No. 531,719, Dec. 11, 1974, abandoned.

[30] Foreign Application Priority Data

Dec. 14, 1973 Italy ..... 70699/73

[52] U.S. Cl. ..... 197/16; 197/18; 197/55

[51] Int. Cl.[2] ..... B41J 23/02

[58] Field of Search ..... 197/17, 16, 18, 19, 197/55, 98

[56] References Cited

UNITED STATES PATENTS

| | | | |
|---|---|---|---|
| 3,135,371 | 6/1964 | Young | 197/16 |
| 3,151,722 | 10/1968 | Salto | 197/17 |
| 3,191,740 | 6/1965 | Smusz et al. | 197/16 |
| 3,404,765 | 10/1968 | Gassino et al. | 197/55 |
| 3,537,562 | 11/1970 | Caudill et al. | 197/17 |
| 3,592,309 | 7/1971 | Craft | 197/16 |
| 3,679,037 | 7/1972 | Bennet | 197/19 |
| 3,718,243 | 2/1973 | Chuatlinsky | 197/16 |
| 3,817,366 | 6/1974 | Blum | 197/16 |
| 3,827,542 | 8/1974 | Blum | 197/16 |
| 3,828,909 | 8/1974 | Roano et al. | 197/16 |

*Primary Examiner*—Edward M. Coren

[57] ABSTRACT

A keyboard for a typewriter, teleprinter, calculator and similar office machines comprises a series of keys, a series of setting elements selectable by the keys and a group of code bars. A setting spring moves a common setting member which positions the selected setting element on the trajectory of the code-bars. A bridge controls the code-bars and is positioned, through a cam, by a driven part of a starting clutch for a setting cycle. An intermediate member connects the common setting member with a releasing member of the starting clutch, and when the key is depressed, the intermediate member activates the starting clutch after a predetermined path of the setting member. A series of flexible laminae are flexed by the selected setting element and successively arrest temporarily the returning at rest of the selected setting element avoiding the beginning of a new setting cycle in the case a key is kept depressed.

24 Claims, 8 Drawing Figures

KEYBOARD FOR OFFICE MACHINES

This is a continuation of application Ser. No. 531,719 filed Dec. 11, 1974, now abandoned.

BACKGROUND OF THE INVENTION

The present invention relates to a keyboard for office machines, comprising: a series of keys each movable from a rest position to a working position, a group of code-bars movable along a predetermined trajectory, a group of springs for pulling said code-bars along said trajectory, a bridge for controlling said code-bars against the action of said group of springs and a series of setting elements selectable by each of said keys, when in said working position, for arresting some of said code bars against the action of the corresponding spring according to a corresponding code combination.

In one known keyboard of this type, by depressing a key a corresponding setting element is released and is placed by a corresponding spring in the paths of the code bars. A universal bar actuated, by the released element, in turn frees the bridge controlling the cams. The universal bar moreover, through a solenoid, recovers the released setting element and brings it back into the intital position against the action of the corresponding spring. The setting rate is rather limited, since owing to the single movement of the setting element through its spring, it is not possible to press a second key and to position a second setting element until the universal bar has returned the first setting element to its rest position.

A keyboard is also known in which a setting lug is pulled by a setting spring and is held by a releasable tooth of a selected setting element. The lug, when it is free, shifts the selected setting element in order to position a plurality of code-bars by the same setting spring according to combinations of codes corresponding to the depressed key. The freed lug moreover operates a starting clutch, which restores the setting spring at the end of the setting cycle. This keyboard is very rapid in use, but, since the setting spring is given the duty of positioning the bars, it has to be fairly robust, and therefore the releasing means must be rather complex and expensive.

SUMMARY OF THE INVENTION

An object of the present invention is to provide a keyboard for typewriters, teleprinters, calculators and other office machines, which is relatively simple and inexpensive, and in which shall be possible to effect rapid fingering.

Another object of this invention is to provide a keyboard for office machines which is light and reliable in the fingering thereof.

The foregoing and other objects, features, and advantages of the invention will be apparent from the following more particular description of the preferred embodiment of the invention as illustrated in the accompanying drawings.

DETAILED DESCRIPTION OF THE INVENTION

Figure 8:
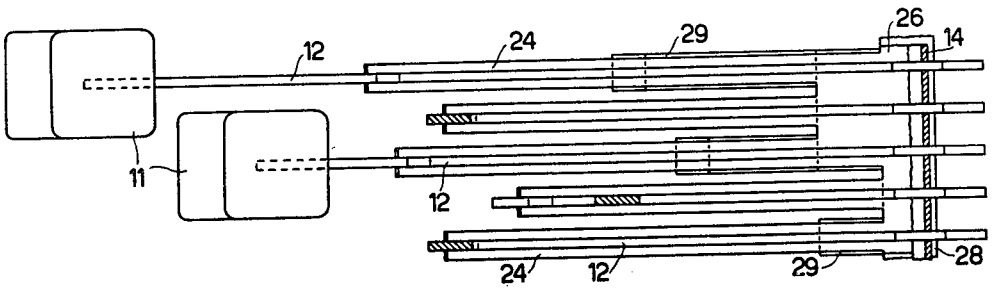
FIG. 8 is a plan view of other details of FIG. 1.

The embodiment of the keyboard described here applies to an electric typewriter. The keyboard comprises the usual keys 11 (FIG. 1) carried by the respective key-carrier levers 12 of different lengths so as to show the keys 11 aligned and distributed in several parallel rows as in normal keyboards. The key-carrier levers 12 are vertically movable, each having a fulcrum in a slot 13 of a support plate 14 integral with a frame 16 (FIG. 2) of the keyboard. Each lever 12 (FIG. 1) is guided by the slots 17, 18 and 19 of a cover 21 and by a slot 22 of the support plate 14. In addition, each lever 12 has a lower tongue 23 against which presses an elastic lamina or leaf 24 of a comb-like leaf spring 26 (FIG. 8) fixed at a lower level than the support plate 14 on a plate 28. The length of the leaves 24 and the distances of the tongues 23 from the slot 13 (FIG. 1) are proportional to the lengths of the levers 12. Each one of the key-carrier levers 12 is normally held by the respective leaf 24 in the rest position against a rubber stop 27 on the underside of the cover 21.

The plate 28 has a substantially rectangular shape with a series of rigid tongues or laminae 29 (FIG. 8), which stretch under respective leaves 24 so that the leaves 24 press on the free ends of the laminae 29. Corresponding with the leaves 24 associated with the shortest key-carrier levers 12, the plate 28 does not have any laminae 29. The length of the laminae 29, compared with the length of the levers 12 and the leaves 24 is such that, when acting on each key 11, the lever 12 bends the respective leaf 24 with a fulcrum either on the end of the lamina 29 or else on the attachment zone of the plate 28 to the support plate 14 so as always to obtain constant and equal pressure for each key.

The key-board comprises a series of setting elements along the length of the keyboard, indicated in general by 31 (FIG. 1), each of which is composed of a frame-like lamina 32 of generally rectangular outline. Each lamina 32 has an upper edge designed to cooperate with the lower surface of the corresponding leaf 24 and is provided with a lug 33 designed to cooperate with a control frame 34 for controlling release of the setting elements 31. The opposite edge of the lamina 32 is provided with three tongues 36, 37 and 38.

The first tongue 36, located at the back extremity of the lamina 32, is perpendicular to it and ends with a tooth 39 designed to be engaged by a setting member or common bar 41 composed of an L-section bar. The first tongue 36 is designed to cooperate with a group of code-bars; indicated in general by 42.

The second and intermediate tongue 37 has a portion substantially parallel to the tongue 36 and another inclined portion guided by a respective groove 45 of a support 49 and provided with a rear sholder 43 designed to cooperate with an inclined surface 44 (FIG. 2) of an anti-repeat element 46 during one operating phase of the keyboard. The portion of the second tongue 37 (FIG. 1) parallel to the tongue 36 has a front shoulder 53, which is designed to cooperate with the support 49 during another operating phase of the keyboard. Finally, the tongue 37 has another, somewhat concave front shoulder 48 which is designed to cooperate with a surface 47 of the anti-repeat element 46 during a further operating phase of the keyboard. The setting element 31 in its turn is normally held at rest by an associated spring 51, with the lamina 32 stopped against an arrest bar 52 and with the front shoulder 48 lodged against the support 49.

The third tongue 38 is substantially parallel to the tongue 36 and is designed to cooperate with blocking elements indicated generally at 54. The tongue 38 is located near the front and of the lamina 32 end is connected to this end through a C-shaped part 57 provided with two semicircular edges 58 and 59 opposite each other and designed to guide the setting element 31 on a plate 61 of the support 49. In addition, each setting element 31 is guided, by means of the C-shaped part 57, in a longitudinal slot 62 of the support 49 and, by the tongue 38, in a slot 63 of a support plate 64.

Figure 1:
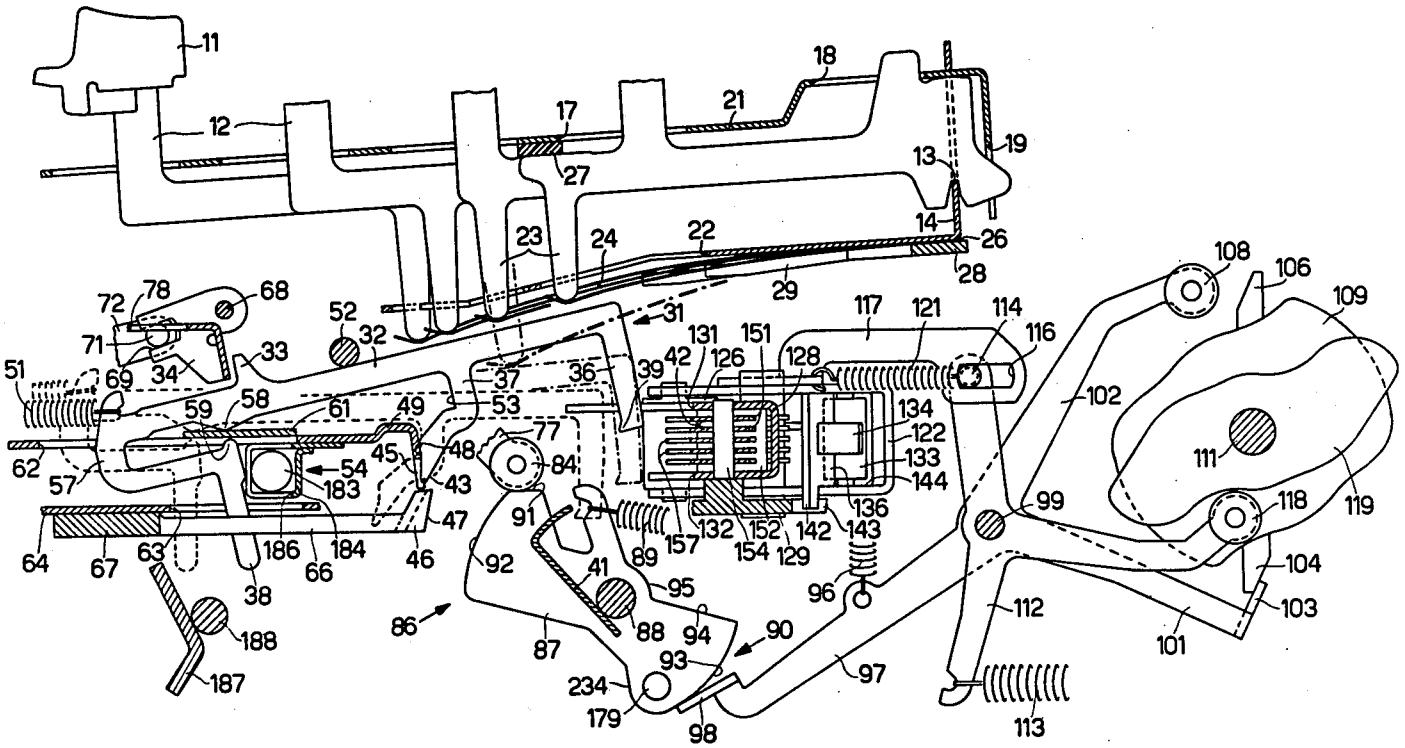
FIG. 1 is a longitudinal sectional view of a keyboard embodying the invention.
Figure 2:
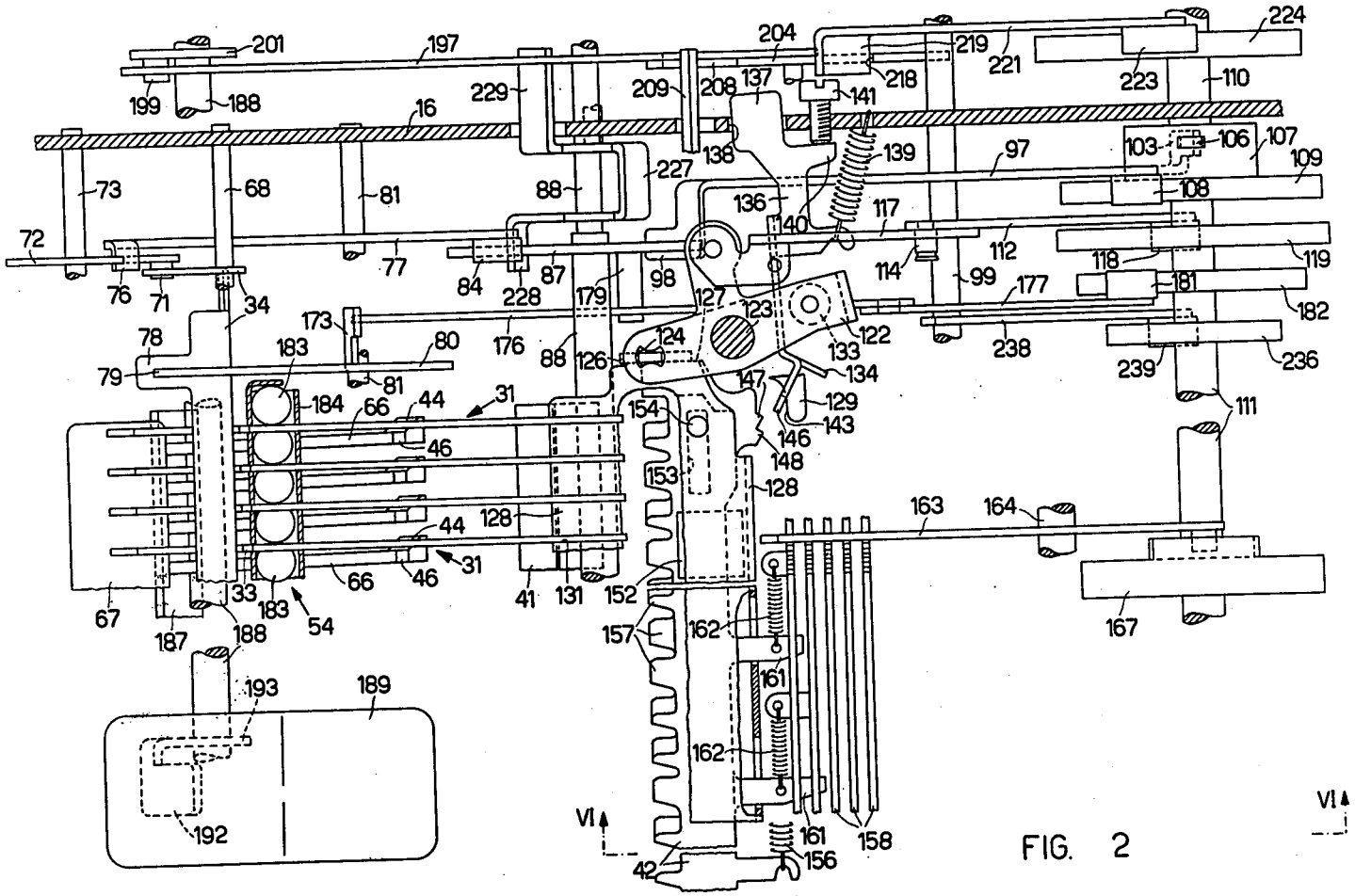
FIG. 2 is a view in partial section in the plane of the keyboard of FIG. 1.

Each anti-repeat element 46 constitutes one end of an elastic lamina 66 of a series of laminae which at the other ends are integral with a plate 67 fixed below the support plate 64 which is attached to the frame 16 (FIG. 2). Each elastic lamina 66 is located to correspond with the respective setting element 31 and is positioned below it. Each lamina 66 lies in a plane inclined relative to the plane of the corresponding setting element 31 and it is designed to bend laterally when the rear shoulder 43 (FIG. 1) engages the inclined surface 44 (FIG. 2) of the anti-repeat element 46.

The control frame 34 for setting-element release has its fulcrum on an axis 68 (FIG. 3) and is located above the setting elements 31. The frame 34 has a slot 69 receiving a pin 71 of a first release lever 72. This lever 72 has its fulcrum on an axis 73 and has an L-shaped shoulder 74 designed to cooperate with a lug 76 of a second release lever 77. The control frame 34 has a lug 78 designed to cooperate with an end 79 of a frame-loading lever 80 with its fulcrum on an axis 81. A spring 82 normally holds the first release lever 72 biased and stopped with the L-shaped shoulder 74 against the lug 76. The second release lever 77 has its fulcrum on the axis 81 and is provided with a roller 84 designed to cooperate through the action of a spring 83 with the cam-edge shown generally as 86 of a cam-profile plate 87.

Figure 3:
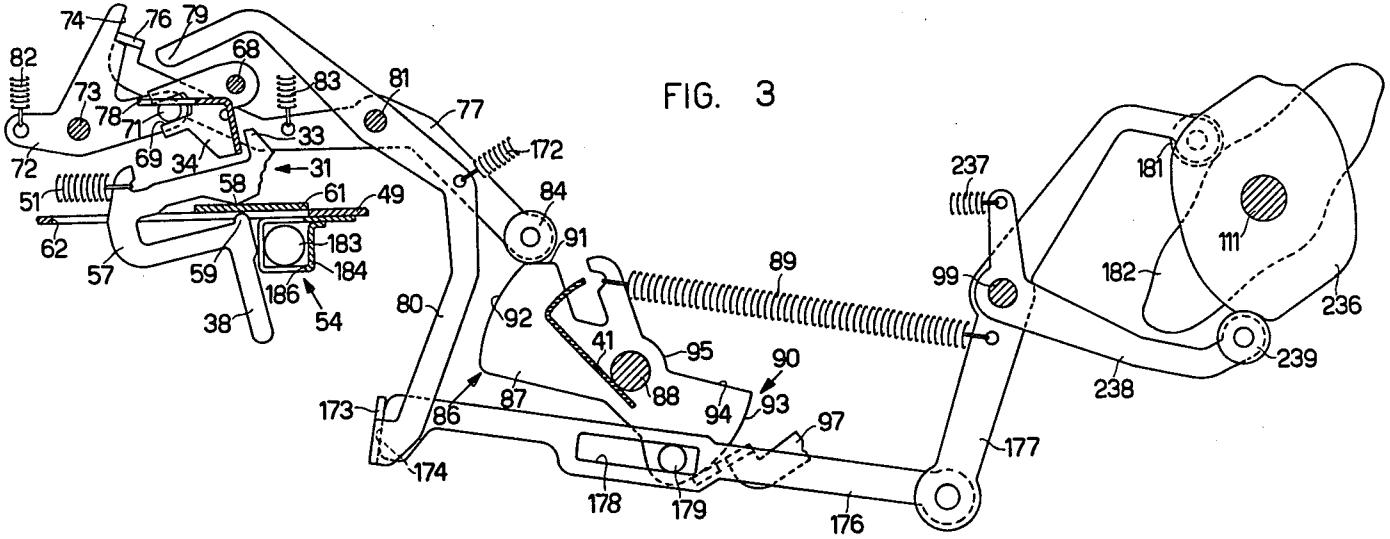
FIG. 3 is a longitudinal view of some details of FIG. 2.

The cam-profile plate 87 rotates integrally with the common bar 41 and with a shaft 88 rotatable in the frame 16 (FIG. 2). A setting-element spring 89 (FIG. 3) tends to rotate the cam-profile plate 87 clockwise together with the common bar 41 and the shaft 88. The cam-edge 86 has a first steep track 91 which, under the action of the setting-element spring 89, pushes the lug 76 against the L-shaped shoulder 74. The spring 83 would tend to remove the lug 76 from the L-shaped shoulder 74, but the action of the setting-element spring 89 prevails over that of the spring 83, so that the second release lever 77 is normally held against the L-shaped shoulder 74 of the first release lever 72 and keeps the central frame 34 positioned as it is shown in FIG. 3. In addition, the cam-edge 86 has a second track 92 having a uniform profile, which is designed to keep the roller 84, through the action of the spring 83, in engagement with the second release lever 77 so as to hold the lug 76 in an intermediate position in which it stops the first release lever 72 in an operating phase.

The common bar 41 is connected to a starting cluch 107 (FIG. 2) through an intermediate lever 97 and a lost motion connection 90 (FIG. 1). The intermediate lever 97 has its fulcrum on an axis 99 and has two arms 101 and 102 arranged at an angle of 90° to each other. The arm 101 has a lug or wing 103 designed to cooperate with two release members or teeth 104 and 106 of the starting clutch 107 (FIG. 2). This clutch 107 has a driving part carried on a motor shaft 110 which is continuously rotatable counterclockwise (in FIG. 1) by the action of an electric motor not shown on the drawings, clutch 107 also has a driven part on which are mounted the release members 104 and 106. The lug 103 (FIG. 1) is designed to selectively stop these release members 104 and 106 either at rest or at the end of each cycle of an operating phase in order to open the clutch 107 (FIG. 2) and thus hold the driven part stopped. The arm 102 (FIG. 1) has a roller 108 designed to cooperate with a clutch-control cam 109 when the lug 103 is outside the path of the teeth 104 and 106. The clutch-control cam 109 is rotatably integral with a cam-bearing shaft 111 fixed on the driven part of the starting clutch 107 (FIG. 2). Also fixed on the cam-bearing shaft 111 (FIG. 3) is a re-loading cam 182 with which cooperates a roller 181 of a re-loading lever 177, rotatable on the axis 99 under the action of the setting-element spring 89 which is stretched between the cam-profile plate 87 and the same re-loading lever 177. To the lever 177 there is pivotally one extremity of a connecting rod 176, which has a slot 178 designed to receive a pin 179 of the cam-profile plate 87. The other extremity of the connecting-rod 176 has a shoulder 174 which is designed to hold a lug 173 of the frame-loading lever 80 by the action of a spring 172 on the lever 80. The lost motion connection 90 (FIG. 1) comprises the cam-profile plate 87 which has a first circular sector 93 concentric with the shaft 88 and diametrically opposite the cam-edge 86, a edge 94 which joins the first circular sector 93 to a second circular sector 95 having a radius substantially smaller than the first, and a lug 98 of the intermediate lever 97 which is held against the first sector 93 by the action of a spring 96 on the intermediate lever 97.

A code-bar control lever 112, with a fulcrum on the axis 99, is counter-clockwise direction by a spring 113 until it pushes a pin 114 against the front end of a slot 116 in a connecting rod 117. The code bar control lever 112 is designed to cooperate, in the working phase, by means of a roller 118, with a code-bar-control cam 119 fixed on the cam-bearing shaft 111. The lever 112 is also connected to the connecting rod 117 by a spring 121, which functions as a normal elastic joint during the operation of the keyboard, as will be described below.

The connecting rod 117 is connected to a code-bar control bridge 122 mounted on an axis 123 (FIG. 2) and is provided with two slots 124 in which the extremities of a tiltable plate 126 are lodged and have their fulcra. The slots 124 are conveniently shaped in the form of circular sectors to permit small angular displacements of the tiltable plate 126 about a vertical axis. By means of the code bar control lever 112 and the connecting rod 117, the tension of the spring 113 (FIG. 1) holds the code bar control bridge 122 normally in such a position that the tiltable plate 126 is against a shoulder 127 (FIG. 2) of a U-shaped support 128. This support 128 is in turn fixed transversely to the keyboard on a plate 129 (FIG. 1) integral with the frame 16 (FIG. 2) and comprises in its upper part a series of slots 131, each of which is designed to guide the first tongue 36 (FIG. 1) of the respective setting-element 31. In addition, the support 128 comprises a series of lower slots 132, each designed for further guidance of the corresponding tongues 36 during the final setting phase.

The code bar control bridge or bail 122 comprises also a peg 133 designed to cooperate with a lug 134 of a bar-loading pawl 136. The pawl 136 is guided by means of a lug 137 (FIG. 2) in a slot 138 of the frame 16 and is normally held by a spring 139 in such a position that a lug 140 bears against an adjustable stop 141 and in such a position that lug 142 (FIG. 1) against a shoulder 143 of the plate 129. The pawl 136 is also guided above and below by the internal walls 144 of the bail 122. The pawl 136 finally comprises a lug 146 (FIG. 2) designed to cooperate selectively with saw-toothed parts of each code-bar 42, composed of two shoulders 147 and 148 having a saw-tooth shape.

The code-bars 42 are five elongated and substantially rectangular laminae, sliding transversely relative to the setting elements 31 in respective grooves 151 (FIG. 1) machined in a block 152 fixed between the arms of the U-shaped support 128. Each code-bar 42 is provided with two slots 153 (FIG. 2) designed to lodge as many pins 154 fixed to the plate 129 and to the support 128 in order to be guided laterally with respect to its path. The drawings show a single slot 153 with the associated pin 154. The code bars 42 are normally pulled by individual springs 156 against the tiltable plate 126 which in its normal position as a result of the over-riding action of the spring 113 (FIG. 1) against the springs 156 (FIG. 2) of the code bars 42.

The code-bars 42 are provided, on the longer edge turned towards the setting elements 31, with a series of selector teeth 157. These teeth 157 are of different thicknesses and are designed to cooperate in the working phase with the setting elements 31 which are selectively actuated to position the code bars 42 in at least three different positions, so as to generate a combination of positions according to a code corresponding to the depressed key. In particular, a first position, of minimal displacement, corresponds to the presence of a broad tooth 157, a second position, of intermediate displacement, corresponds to the presence of a narrow tooth 157, and a third position, of maximum displacement, corresponds to absence of selector teeth 157 and results in displacement equal to the path of the tiltable plate 126.

Figure 7:
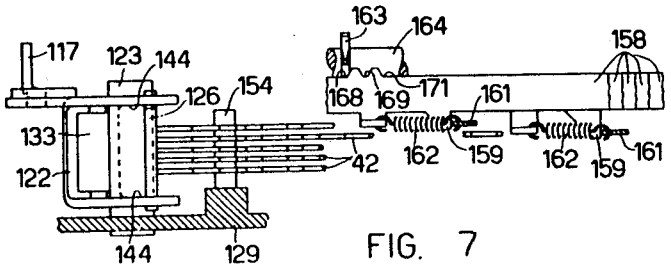
FIG. 7 is a transverse view of FIG. 6.

A series of five bars or decoding elements 158 is connected in an essentially known manner to a decoding unit not shown in the drawings and described in U.S. Pat. No. 3,404,765 of Gassimo et al, assigned to the same assignee as this application, and incorporated herein by reference. U.S. Pat. No. 3,404,765 of Gassimo relates to a printing device for typing a character corresponding to the key depressed. Each decoding element 158 has a lug 159 (FIG. 7) designed to cooperate with a lug 161 of the corresponding code-bar 42. A spring 162 normally holds the respective decoding element 158 arrested with the lug 159 against the lug 161. Therefore every decoding element 158 during the operating phase is placed in the working position by a displacement equal to that of the corresponding code-bar 42.

A positioning member 163 is designed to cooperate with three shoulders 168, 169 and 171 of each decoding element 158 for positive arresting of these decoding elements 158 in each of the three working positions in such a way that, while the elements 158 are arrested in such working positions and are cooperating with the decoding group, the code-bars 42 are brought back by the bail 122 into the rest position in the manner to be described below. This positioning member 163 is composed of a lever with its fulcrum on an axis 164 which by means of a spring 166 (FIG. 6) cooperates with a positioning control cam 167 keyed on the cam-bearing shaft 111.

The blocking elements 54 (FIG. 1) prevent setting more than one setting element 31 simultaneously blocking elements 54 comprise a plurality of spheres 183 arranged in a container 184 fixed to the support 49 and having a series of grooves 186, each of which is arranged to correspond with the related setting-element 31. The number of spheres 183 in the container 184 is equal to the sum of the number of setting elements 31 plus one; in the specific case the setting-elements 31 are forty five and hence the spheres 183 amount to forty five. The size of the spheres 183 and the length of the container 184 are defined so that there exists a small gap between the spheres, sufficient to permit insertion of a single tongue 38 of a setting-element 31. Therefore by actuating a single key 11 to move the required setting-element 31 in the manner to be described below, the tongue 38 is inserted between two neighbouring spheres 183, taking up the gap between them and allowing the setting-element 31 to move fully. If on the other hand, two keys 11 are depressed simultaneously, the gap existing between the spheres 183 is insufficient to allow insertion of both tongues 38, so that the two setting-elements 31 complete a path which is insufficient to start the cycle, thus avoiding starting errors.

In order to prevent activation of the keys 11 when the keyboard is not functioning because the typing machine is switched off, the keyboard comprises also a bar 187 arranged transversely and below the setting-elements 31. The bar 187 is wide enough to cooperate simultaneously with all of the tongues 38 of the setting-elements 31, and is fixed on a shaft 188 rotatable on the frame 16 (FIG. 2). An "on-off" key 189 (FIG. 5) shown in the "on" position, has one extremity 191 designed to cooperate with a lug 192 of a lever 193 integral with the shaft 188. The key 189 has a connecting rod 190 connected in a known manner to an interruptor also not shown in the drawings, to activate the electric motor and hence put into rotation the motor shaft 110. A spring 194 holds the lever 193 normally turned counter-clockwise and therefore holds the bar 187 at a distance from the tongues 38. By turning the key 189 into the "machine-off" position as shown by the dashed line in FIG. 5, the upper extremity of the bar 187 is placed instead against the tongues 38, preventing the setting-element 31 from working.

The keyboard described functions in the following manner. The key 189 is turned to the position shown by the continuous line in FIG. 5. In this way the bar 187 is removed from the tongue 38 leaving the setting-elements 31 free to be positioned. At the same time the connecting rod 190 closes the interruptor, setting in rotation the electric motor and hence the motor shaft 110. By depressing any key 11. (FIG. 1), the corresponding key-carrier lever 12 is turned and depressed against the action of the leaf 24 associated with it. The lower part of the leaf 24 engages the upper edge of the lamina 32 causing depression of the setting-element 31 as shown by dot-and-dash lines in FIG. 1, i.e. a preliminary movement. The setting element 31 then slides its concave front shoulder 48 along the support 49, which constitutes an arresting member, with semicircular edges 58 and 59 of setting element 31 bearing on the plate 61. As soon as engagement between the front shoulder 48 and the support 49 terminates, the spring 51 pulls the setting-element 31 forward (to the left in FIG. 1), this being referred to as the first movement. In addition, the action of the sloping part of the tongue 37 on the bottom of the groove 45 lowers the setting-element uniformly, so that takes a horizontal position until the front shoulder 53 is held up against the support 49, as it is shown by the hatched line in FIG. 1.

During this movement, the lug 33 engages the control frame 34, making it turn clockwise against the action of the spring 82 (FIG. 3). The L-shaped shoulder 74 of the first release lever 72 disengages from the lug 76, freeing the second release lever 77 so that the setting-element spring 89 makes the common bar 41 turn clockwise with the cam profile plate 87, and the second release lever 77 turn counter-clockwise against the action of the spring 83. The common bar 41 now engages the tooth 39 (FIG. 1) of the tongue 36 and moves the setting element 31 back (to the right in FIG. 1) against the action of its associated spring 51, this being referred to as the second movement. The tongue 38 is inserted between two contiguous spheres 183, filling the gap existing between the spheres 183 and engaging the corresponding groove 186 of the container 184. During rotation of the cam-profile plate 87 (FIG. 4), the roller 84 ends its cooperation with the first steep track 91 and engages the second constant track 92 due to the action of the spring 83 on the second release lever 77.

Figure 4:
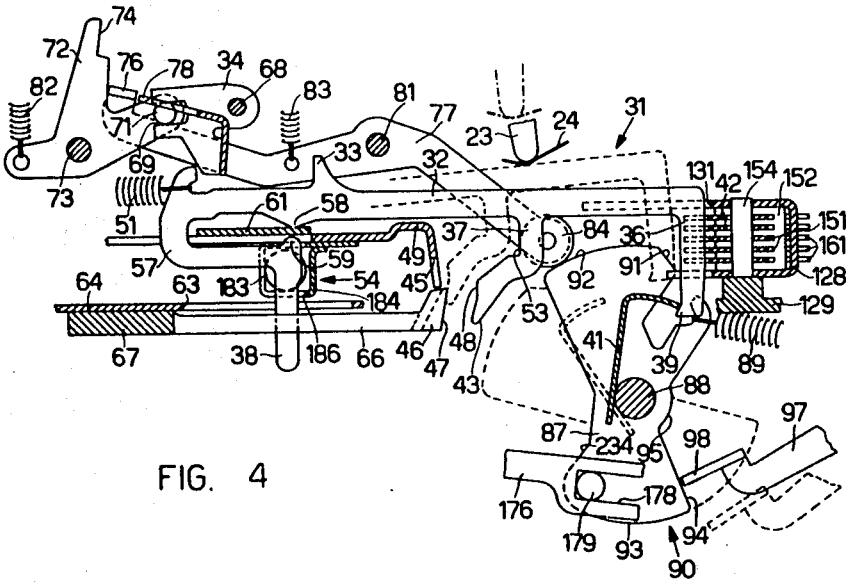
FIG. 4 is a longitudinal view of the details of FIG. 3 in a working position.

The common bar 41 and the cam-profile plate 87 continue to turn, pulled by the setting element spring 89, until the pin 179 is stopped against the end of the slot 178 in the connecting rod 176. The setting element 31 then also ends its course, arranging itself with the tongue 36 on the trajectory of the selection teeth 157 (FIG. 2) of the code-bars 42. Immediately before the cam-profile plate 87 has reached the end position of the working path, as shown in FIG. 4, the lug 98 ends its cooperation with the first sector 93. The spring 96 (FIG. 1) makes the intermediate lever 97 to turn clockwise: disengages the lug 103 from the releasing tooth 104 of the starting clutch 107 (FIG. 2) and simultaneously brings the roller 108 (FIG. 1) to cooperate with the clutch-control cam 109. The starting clutch 107 (FIG. 2) closes so that the cam-beaing shaft 111 is put in rotation counterclockwise together with the cams 109, 119, 167 and 182.

The code bar-control cam 119 (FIG. 1) makes the code-bar control-lever 112 turn clockwise against the action of the spring 113. The pin 114 then slides in the slot 116 and loads the spring 121 of the elastic joint, turning the bail 122 (FIG. 2) clockwise. The tiltable plate 126 thus frees the code-bars 42, permitting the springs 156 to displace the respective code-bars 42 leftwards (upwards in FIG. 2) until the selector teeth 157 are stopped against the setting-element 31 which has already been positioned according to the code of the depressed key. Along with the positioning of the code-bars 42 there is also simultaneous positioning of the associated decoding elements 158, by means of the lugs 161 (FIG. 7) and the lugs 159.

The positioning-control cam 167 (FIG. 6), after a short rotation of the cam bearing shaft 111, permits the spring 166 to make the positioning member 163 turn counter-clockwise to engage selectively, according to the course of the code-bars 42, the shoulders 168, 169, 171 (FIG. 7) of the corresponding decoding elements 158 to stop them in the positions thus reached. The decoding elements 158 can now cooperate with the decoding unit illustrated in the U.S. Pat. No. 3,404,765 cited above, for example to position a character-bearing element for typing the character.

Shortly before the end of the rotation of the code bar-control bail 122, the peg 133 (FIG. 2) engages the lug 134, making the bar-loading pawl 136 turn clockwise against the action of the spring 139. The lug 146 engages the saw-toothed shoulder 147 of the code-bars 42 which have undergone minimal displacement, and the shoulders 148 of the code bars 42 which have undergone medium displacement, pushing the code bars 42 themselves briefly to the right (downwards in FIG. 2) against the action of the respective springs 156. This brief displacement allows the spring 51 (FIG. 1) suddenly and rapidly to move the relevant setting-element 31. Otherwise the tensions of the springs 156 (FIG. 2) corresponding to the code-bars 42 positioned in correspondence with minimal displacement or medium displacement, would prevent the spring 51 (FIG. 1) from rapidly recovering the respective setting-element 31 when the common bar 41 is returned to rest.

The clutch-control cam 109 then turns the intermediate lever 97 counter-clockwise, against the action of the spring 96, bringing the lug 98 out of the path of the first sector 93 of the cam profile plate 87, as shown by the dashed line in FIG. 4. Further, the lug 103 of the arm 101 (FIG. 1) is brought on to the path of the releasing member 106.

The reloading cam 182 (FIG. 3) turns the reloading lever 177 clockwise against the action of the setting element spring 89. This activates the connecting rod 176 which, with the end of the slot 178 engaged by the pin 179, turns the cam profit plate 87 and the common bar 41 counter-clockwise, bringing them into the rest position and reloading the setting-element spring 89. The setting-element 31, pulled forward (leftwards in FIG. 4) by the associated spring 51, follows the common bar 41 till it engages the front shoulder 48 with the surface 47 of the anti-repeat element 46, as shown by the dashed line in FIG. 4. Under the action of the spring 51 the setting-element 31 now tends to rise and return to its original position.

If the particular key 11 previously depressed has not yet been released, the setting-element 31 remains stopped against the surface 47 and the leaf 24 (as shown by the dashed line in FIG. 4). On the other hand, if the key 11 has been released, the setting-element 31 continues to rise, being pulled by the spring 51, until it stops in the rest position with the upper edge of the lamina 32 held against the arrest bar 52 (FIG. 1) and with the front shoulder 48 stopped against the support 49. At the same time the spring 172 (FIG. 3) turns the frame-loading lever 80 counter-clockwise, to bring the end 79 into engagement with the lug 78 of the control frame 34 to assist its return to rest.

After 90° rotation of the code bar-control cam 119 (FIG. 1) the spring 113 makes the code-bar control lever 112 turn counter-clockwise. The pin 114 engages the end of the slot 116 and by means of the connecting-rod 117 makes the code-bar control bail 122 (FIG. 2) turn counter-clockwise. The peg 133 then releases the lug 134, so that the spring 139 returns the bar loading pawl 136 to its starting position. During its rotation, the code-bar control bail 122, by means of the tiltable plate 126 restores the code-bars 42 against the action of the respective springs 156 and finally stops against the shoulder 127. Meanwhile the decoding elements 158 remain in the working position, blocked by the positioning member 163 against the action of the respective springs 162, to permit operation of the decoding group.

During the return to rest of the cam profile plate 87 (FIG. 3), the roller 84 disengages from the second track 92 and re-engages with the first steep track 91. The second release lever 77, following the first steep track 91 under the action of the spring 83, then turns clockwise and moves the lug 76 as far as the L-shaped shoulder 74, allowing the spring 82 to turn the first release lever 72 with the shoulder 74 stopped against the lug 76, and simultaneously brings to rest the control frame 34 with the assistance of the frame loading lever 80. After the reloading cam 182 has turned through about 90°, the setting-element spring 89 returns to rest the reloading lever 177 with the connecting rod 176 also restoring to rest the frame-loading lever 80.

The setting-element spring 89 now tends again to make the cam-profile plate 87 turn clockwise, but is hindered in this by the second release lever 77, since the lug 76 of the latter is engaged with the L-shaped shoulder 74, and remains in its rest position.

The clutch-control cam 109 (FIG. 1) after a rotation of about 140°, permits the intermediate lever 97 to turn clockwise under the action of the spring 96. The lug 98 then engages the first circular sector 93, by which the intermediate lever 97 is stopped and places the lug 103 in the path of the releasing tooth 106.

In these last phases the positioning control cam 167 (FIG. 6) turns the positioning member 163 clockwise against the action of the spring 166, so that the decoding elements 158 are set free and the respective springs 162 (FIG. 7) bring them back into the rest positions with the lugs 159 stopped against the lugs 161 of the code bars 42.

After 180° rotation of the cam-bearing shaft 111 (FIG. 1), the releasing tooth 106 is stopped by the wing 103 so that the starting clutch 107 (FIG. 2) is opened and the cam-bearing shaft 111 stops rotating. The keyboard is thus back in its condition of rest, and it is therefore again possible to operate a key.

If a second key 11 (FIG. 1) is depressed before setting of the bars 42 has been completed in accordance with the first key 11, another setting-element 31 is moved in the manner described. If the first setting-element 31 has already moved back (to the right in FIG. 1) the upper back part of the common bar 41, consisting of the smaller side of its L-shaped profile, is already in the trajectory of the tongue 36 of the second setting-element 31. The latter, by the action of the corresponding spring 51 and the sloping part of the tongue 37 on the support 49, is depressed further only until the tooth 39 rests on the upper back part of the common bar 41 and memorises the setting command. During the phase in which the common bar 41 returns to rest, the back of the common bar 41 frees the tooth 39 of the second setting-element 31. The latter can then turn clockwise to lower itself further, and is pulled by the spring 51 to stop with the front shoulder 53 against the support 49 and with its lug 33 prevents the control frame 34 from returning to rest, so that the lug 76 (FIG. 3) does not engage the L-shaped shoulder 74 of the first release lever 72, and the plate 87 is not held in its rest position, so that the setting element cam profile spring 89 induces a fresh rotation of the common bar 41 and hence engages it with the second setting element 31.

Accidental simultaneous activation of two keys 11 (FIG. 1) causes depression of two key-carrier levers 12, which, with the corresponding leaves 24, operate the two setting-elements 31, which are lowered until the front shoulders 48 no longer engage the support 49 and the relative springs 51 pull the two setting elements 31 forward (towards the left in FIG. 3) 31. During this movement, the lugs 33 turn the control frame 34, hooking the lug 76 off the L-shaped shoulder 74 as described above. The setting-element spring 89 thus is free to rotate the cam-profile plate 87 clockwise with the common bar 41. The latter engages simultaneously the two teeth 39 (FIG. 1) of the tongues 36 and begins to move the setting-elements 31 backwards (to the right in FIG. 1), in the direction of the code-bars 42. The two tongues 38 engage in the respective grooves 186 of the container 184, placing themselves between the spheres 183. But the gap between the spheres 183 does not permit passage of both tongues 38, so that the cam-profile plate 87 cannot turn completely, the intermediate lever 97 cannot clear the first circular sector 93, the tooth 104 remains blocked by the wing 103 and hence the starting clutch 107 (FIG. 2) remains open and the keyboard blocked.

Figures 5, 6:
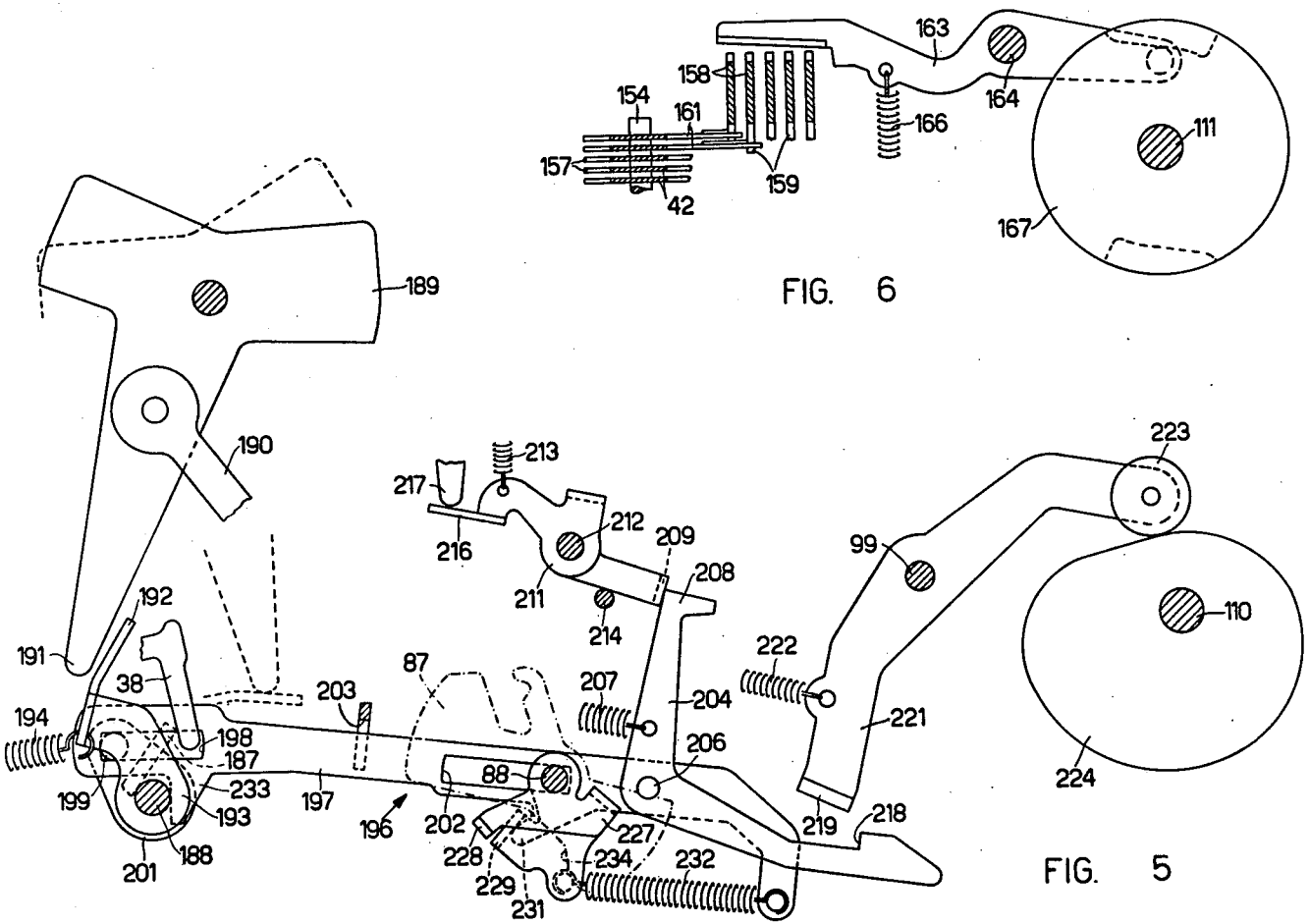
FIG. 5 is a partial longitudinal view of other details of FIG. 2.
FIG. 6 is a partial section according to line VI-VI of FIG. 2.

To free the keyboard which has been blocked as described above, releasing or unblocking means are provided indicated generally by 196 (FIG. 5). These unblocking means 196 comprise a connecting-rod 197 with a slot 198 receiving a pin 199 of a crank 201 integral with the shaft 188. The connecting rod 197 slides longitudinally by means of a second slot 202 on the shaft 38 and is guided laterally by a guide 203 integral with the frame 16 (FIG. 2). A toothed lever 204 (FIG. 5) having as its fulcrum a pivot 206 on the connecting rod 197 is held normally by a spring 207 with one extremity 208 against a lug 209 of a lever 211. The lever 211 is rotatable on a fixed axis 212 and is held by a spring 213 against the fixed stop 214. A lug 216 of the lever 211 is designed to cooperate with a tongue 217 of a blockage release key not shown in the drawings.

The toothed lever 204 has an L-shaped shoulder 218 designed to cooperate with a lug 219 of a lever 221 having its fulcrum on the axis 99. A spring 222 holds the lever 221 with a roller 223 in contact with an unblocking-control cam 224 keyed on to the motor shaft 110.

A bail 227 with a fulcrum on the shaft 88 has a first lug 228 designed to cooperate with an edge 234 of the cam profile plate 87, shown by the dot-and-dash line, and a second lug 229 designed to cooperate with a lug 231 of the connecting rod 197. A spring 232 normally holds the bail 227 turned counter-clockwise, with the second lug 229 against the lug 231, and the connecting rod 197 moved forward (to the left in the Figure), with a lug 233 against the shaft 188.

To unblock the keyboard, the release key is operated, and its tongue 217 engages the lug 216, turning the lever 211 counter-clockwise against the action of the spring 213. The lug 209 disengages from the extremity 208 of the toothed lever 204, permitting the spring 207 to turn the toothed lever 204 counter-clockwise.

Since the unblocking control-cam 224 is fixed on the motor shaft 110 it is always rotating and hence continuously operates the lever 221. Upon the freeing of the toothed lever 204, the lug 219 engages the L-shaped shoulder 218 so that the toothed lever 204 is pulled back to the right in FIG. 5), dragging with it the connecting rod 197. The lugs 231 then disengages from the second lug 229 of the bail 227 and the spring 232 turns the bail 227 counter-clockwise. If the cam-profile plate 87 is in the clockwise position, resulting from blocking of the setting elements 31, the first lug 228 of the bail 227 engages the edge 234 of the cam profile plate 87. The action of the spring 232 on the bail 227 overcomes the action of the sitting element spring 89 (FIG. 1) cam profile plate 87, so that the latter is turned counter-clockwise against the action of the setting element spring 89. At the same time, the connecting rod 197 (FIG. 5), with the end of the slot 198 and the pin 199, turns the crank 201 clockwise together with the shaft 188 and the bar 187. When bar 187 is turned in this way, it meets the tongues 38 of the setting elements 31 which were actuated and blocked between the spheres 183 (FIG. 1) and the tongues 38 of other elements 31 which may have been acuated after the keyboard was blocked. The bar 187 therefore pushes these tongues 38, turning the corresponding setting elements 31 counter-clockwise against the action of the respective springs, until all of the setting-elements 31 have been replaced in their rest positions.

The cam profile plate 87, during rotation towards its rest position, acts on the second release lever 77 (FIG. 3) as already described, and therefore brings the lug 76 back onto the L-shaped shoulder 74, permitting the spring 82 to return the control frame 34 also to rest.

After 360° rotation of the unblocking control-cam 224 (FIG. 5) if the unblocking key has been released, the spring 213 has brought the lever 211 back into its initial position. The lever 221 then allows the spring 232 to bring the connecting rod 197 back to rest with the lug 233 against the shaft 188. The extremity 208 of the toothed lever 204 is held by the lug 209 of the lever 211, so that the lug 219 disengages from the L-shaped shoulder 218 of the lever 204. The bail 227 stops the second lug 229 against the lug 231, while the spring 194 holds the crank 201, with the shaft 188 and the bar 187, stopped with the pin 199 against the end of the slot 198. The keyboard is therefore unblocked, with the various kinematic mechanism at rest and ready for a fresh cycle.

Normally, in a working cycle, the working load of a motor is never uniform because of the profile and the phasing of the cams. In order to minimise possible deleterious effects on the motor, the keyboard contains a compensating cam 236 (FIG. 3) fixed on the compensating cam-bearing shaft 111. A spring 237 holds a lever 238, having its fulcrum on the axis 99, engaged through a roller 239 with the cam 236. The profile and phasing of the cam 236 are planned to give maximum evening of the load on the motor (not shown in the drawings).

What I claim is:

1. A keyboard for a typewriter, teleprinter, calculator and similar office machines comprising: a series of keys each movable from a rest position to a working position: a group of code-bars movably supported along a predetermined trajectory; spring means connected to said code bars for pulling said code-bars along said trajectory from a rest position to an active position; bridge means for controlling said code-bars against the action of said spring means; a series of setting elements associated with said keys, each one of said setting elements being selectable by an associated one of said keys when said key is moved to said working position; a common setting member movably supported between an inoperative position and an operative position, said common setting member when in its operative position being engageable with said selected one of said setting elements to move said selected one of said setting elements into the trajectory of said code-bars, and means for causing a light load upon said selected setting element when another key is moved to said working position in unacceptably rapid succession to a first key, said means for causing a light load comprising a setting spring connected to said common setting member for causing movement of said common setting member from said inoperative position toward said operative position; releasing means normally arresting said common setting member in said inoperative position against the action of said setting spring; means operated by said keys when said keys are in said working position for operating said releasing means to release said setting member from said inoperative position whereby said setting spring moves said common setting member to said operative position and said common setting member thereby causes said selected setting element to move into the path of said code-bars; a starting clutch having a driving motive part, an actuatable driven part and a releasing member operable for connecting said driving motive part to said driven part; an intermediate member connecting said common setting member to said releasing member for operating said releasing member to connect said driving motive part to said driven part when said common setting member moves toward said operative position; reloading means operated by said driven part of said starting clutch for returning said common setting member from said operative position to said inoperative position against the action of said setting spring; sensing means for sensing the selection of another of said setting elements by another said key moved to said working position while said common setting member is in the operative position; said sensing means being interconnected with said common setting member to permit said common setting member to engage said other of said setting elements only immediately after said common setting member returns to said inoperative position; and cam means operatively connecting the driven part of said starting clutch with said bridge means for positioning said bridge means with respect to said code-bars to control movement of said code-bars between said rest position and said active position so that said one and said other of said selected setting elements arrests in two following cycles some of said code-bars, against the action of said spring means, according to the coded combination corresponding to said one and said other key moved in said working position.

2. A keyboard as defined in claim 1, wherein said releasing means comprises a releasing frame engageable by the selected setting elements, a spring biased first release lever engageably by said releasing frame and movable thereby, a profile cam fixed to said common setting member and having a steep edge portion and a constant portion, a second release lever normally in hooking engagement with said first release lever to hold said first release member against movement by said spring bias, said second release member also being normally in contact with said steep edge portion of said profile cam thereby to hold said common setting member in said inoperative position against the action of said setting spring, said second release member also being selectively movable into alignment with said constant edge portion, thereby to allow said common setting member to be moved toward said operative position.

3. A keyboard as defined in claim 1, further comprising a lost motion connection connecting said common setting member to said intermediate member, said lost motion connection comprising a movable element engageable by said common setting member when said common setting member for arresting and releasing said intermediate member when said common setting member is in, respectively, said operative position and said inoperative position, said lost motion connection operating said intermediate member to actuate the driven part of said starting clutch when movable element has released said intermediate member.

4. A keyboard as defined in claim 3, wherein said intermediate member comprises an intermediate lever and wherein said movable element of said lost motion connection comprises a cam profile having a first sector of a predetermined radius, a second sector having another radius substantially smaller than said predetermined radius and a steep edge connecting said first sector with said second sector; said spring means causing an operative portion of said lever to cooperate with said first sector when said common setting member is in said inoperative position and with said second sector, when said common setting member is in the operative position, so that said spring rapidly pulls said intermediate lever to actuate the driven part of said starting clutch when said operative portion of said intermediate lever cooperates with said second sector, in the operative position of said common setting member.

5. A keyboard as defined in claim 4, wherein said reloading means comprises a clutch control cam operatively connected with the driven part of the starting clutch and a rod connecting said control cam with said common setting member for causing said common setting member to return to said inoperative position upon releasing of said code-bars; and wherein the releasing member of the starting clutch is carried by the driven part thereof and said intermediate lever includes two arms, the first of said arms cooperating with said releasing member for the operation thereof, and the second of said arms cooperating with the clutch control cam for returning the operative portion of said intermediate lever from the second sector into cooperation with said first sector against the action of said spring means upon returning of said common setting member to said inoperative position by said rod.

6. A keyboard as defined in claim 3, further comprising reciprocal blocking elements arranged adjacent said setting elements and displaced to leave a gap therebetween allowing the setting of said one selected setting element, but preventing the simultaneous setting of two of said setting elements in the trajectory of said code-bars by blocking, stopping two simultaneous selected setting members and said common setting member after a path insufficient to operate the releasing member of said starting clutch, when said common setting member engages simultaneously said two selected setting elements; and unblocking means for returning said common setting member to said inoperative position, independently from the driven part of said starting clutch.

7. A keyboard for a typewriter, teleprinter, calculating and similar printing machines comprising: a series of keys each movable from a rest position to a working position; a group of code-bars movably supported along a predetermined trajectory; spring means connected to said code-bars for pulling them along said trajectory from a rest to an active position; bridge means for controlling said code-bars against the action of said spring means; a series of setting elements associated with said keys and each one selectable by one associated of said keys moved in said working position; a common setting member movably supported by the keyboard between an inoperative position and an operative position for engaging one of said setting elements selected by said one key moved to said working position to move said one engaged setting element into the trajectory of said code-bars; a setting spring for moving said common setting member from said inoperative position toward said operative position; releasing means normally arresting said setting member in said inoperative position against the action of said setting spring; means associated with each of said keys for operating said releasing means to release said setting member when the associated key is moved to the working position, thereby causing said setting spring to move said setting member to set in said operative position said one selected setting element into the trajectory of said code-bars; a starting clutch having a driving motive part, an actuatable driven part and a releasing member operable for connecting said driving motive part with said driven part for the actuation thereof; and intermediate member connecting said common setting member with said releasing member for actuating the driven part of said starting clutch in response to the movement of said common setting member toward said operative position; and cam means operatively connecting the driven part of said starting clutch, with said bridge means for releasing said code-bars from said rest to said active position, so that said one set selected setting element arrests some of said code-bars, against the action of said spring means, according to the coded combination corresponding to said one key moved to said working position, wherein said releasing means comprise a releasing frame displaceable by the selected setting elements; a spring urged first release lever displaceable by said releasing frame; a cam profile fixed to said common setting member; and a second release lever cooperative with said cam profile and normally hooked to said first lever; said cam having a first steep part normally arrested by said second release lever to hold said common setting member in the inoperative position, against the action of said setting spring and a second substantially constant part, enabling said common setting member to be moved toward said operative position and said second release lever to arrest said first release lever against the action of the corresponding spring; and reloading means operatively connecting the driven part of the starting clutch enabling said common setting member to be returned in said inoperative position against the action of said setting spring, upon releasing of said code-bars; a reloading cam positioned by the driven part of said starting clutch; and a lever controlled by said reloading cam for bringing back said common setting element and said releasing frame upon returning of said common setting member in said inoperative position by said reloading means.

8. In a keyboard for a printing machine comprising a series of keys each movable from a rest position to a working position; a series of setting elements associated with said keys and each selectable by one associated of said keys, said setting elements being movable from a rest position to a set position; a common setting member actuatable from an inoperative position to an operative position; spring means moving said common setting member to said operative position in response to moving of each of said keys, said common setting member engaging the selected setting element and positioning said selected setting element in the set position thereof; reloading means controlled by said common setting member in the operative position thereof, for returning said common setting member to said inoperative position for reloading said spring means, restoring means for returning the set setting elements to said rest position; blocking elements for stopping two selected setting elements in a predetermined position intermediate between said rest position and said set position in the case when two keys are simultaneously moved to said working position, said common setting member engaging said two selected setting elements but being arrested by the stopping of said engaged elements by said blocking elements in an arrest position, intermediate between said inoperative position and said operative position, in which said reloading means is not in the path of the setting member returning to the inoperative position whereby blocking a further set of other setting elements; and manually operable unblocking means in the place of said reloading means for returning said common setting member from said arrest position to said inoperative position, enabling the further set of said setting elements, said unblocking means comprising:

an unblocking member continuously oscillatable along a predetermined path;

an unblocking element movable into the path of said unblocking means and engageable by said unblocking member;

an unblocking support movably supporting said unblocking element for the engagement thereof with said unblocking member, said unblocking support being movable by said unblocking element when it is engaged by said unblocking member, said unblocking support being operatively connected to said common setting member for returning said common setting member from said arrest position to said inoperative position upon disengagement of said unblocking element from said unblocking member;

an unblocking spring means for moving said unblocking element into the path of said unblocking member;

a releasing element normally holding said unblocking element out of said path, against the action of said unblocking spring means; and manually operable key means, cooperative with said releasing element, for releasing said unblocking element so that said unblocking spring means puts said unblocking element into the trajectory of said unblocking member.

9. A keyboard as defined in claim 8, further comprising a continuously rotatable unblocking cam, and wherein said unblocking member comprises a follower cam oscillatable by said unblocking cam.

10. A keyboard as defined in claim 8, further including a reloading bar engageable by said setting elements; means supporting said reloading bar between a rest position and an actuated position; and means for connecting said unblocking support with said reloading bar for returning to rest the setting elements arrested in said intermediate position jointly with the return of said common setting member to said inoperative position.

11. A keyboard as defined in claim 10, wherein said common setting member comprises a plate fulcrumed on a fixed axis wherein said unblocking support comprises a connecting rod on which said unblocking element is fulcrumed for the dragging thereof upon engagement by said unblocking member, said connecting rod having a slot by means of which to slide on said axis and wherein said connecting means comprises said connecting rod which is further connected to said reloading bar through a pivot and slot connection.

12. A keyboard as defined in claim 8, wherein said unblocking support comprises a connecting rod connected to said common setting member through an intermediate member cooperative with said common setting member, and an elastic joint element connecting said connecting rod with said intermediate member, said connecting rod supporting said unblocking element by means of a fulcrum to be dragged by said unblocking member upon actuation of said unblocking element.

13. A keyboard as defined in claim 12, wherein said common setting member comprises a plate fulcrumed on a fixed axis and said connecting rod comprises an appendage, wherein said intermediate member comprises a bridge fulcrumed on said axis and having a first wing for cooperating with said plate, a second wing for cooperating with said appendage and wherein said elastic joint comprises elastic means connecting said bridge with said rod for normally holding said bridge arrested with said second wing against said appendage, said elastic means rotating said bridge for the returning of said plate to the inoperative position when said rod is dragged by said unblocking member upon actuation of said unblocking element.

14. A keyboard for printing machines comprising: a series of depressable keys; a series of setting elements associated with said keys; means movably supporting each of said setting elements along a corresponding movement plane; setting means responsive to one depressed of said keys for selectively setting one of said setting elements associated with said one depressed key from a rest position to a set position forwardly along said plane; spring means for resetting said one setting element backwardly from said set position to said rest position along said movement plane; and antirepetitive means for avoiding re-setting of said one setting element from said rest position to said set position in the case when said one associated key is kept depressed, said antirepetitive means including:

a series of members each arranged to correspond to one of said setting elements, each one of said members comprising a first surface and a second surface normally displaced from the movement plane of the corresponding setting element and cooperative with the corresponding setting element, and a yieldable portion carrying said first and second surfaces and allowing said first and second surfaces to be displaced;

said first surface lying at rest in a plane inclined with respect to the movement plane of the corresponding setting element, said first surface being temporarily engageable with said one corresponding setting element being movable thereby out of the movement plane of said one corresponding selected setting element for allowing movement of the corresponding selected setting element in said movement plane;

said second surface lying at rest in a plane substantially perpendicular to said movement plane and temporarily engageable with said one selected setting element to keep said one selected setting element in a predetermined position against the action of said spring means during the backward movement of said one selected setting element; and means for releasing said selected setting element from said predetermined position comprising cam means on said setting element engageable with the second surface of said members under the action of said spring means, and means supporting said setting elements for enabling said spring means to reset the selected setting element in the rest position, until said key which was kept depressed is released.

15. A keyboard as defined in claim 14, wherein each setting element comprises a lamina provided with a first edge wherein said cam means comprises a second edge of said lamina and each of said keys comprises a projection actuatable from a rest position to a depressed position upon depression of the corresponding key and cooperative with the first edge of the lamina, further comprising an arresting element adjacent to said series of members, said spring means normally holding the second edge of said corresponding setting element against said arresting element, said supporting means when said projection is actuated in said depressed position causing said second edge to be released from said arresting element; and an element of said second edge cooperative with the second surface of one corresponding of said series of members, for being arrested by said second surface during the backward movement of the selected setting element, when said projection cooperates with said first edge owing to the key held depressed, said element of said second edge being formed such that said spring means through said support means cause said second edge to be moved from said second surface to said arresting element for being arrested therefrom until returning at rest of said projection.

16. A keyboard as defined in claim 15, wherein each lamina is substantially rectangular and said first edge is a longer edge thereof, wherein said lamina has a wing on said longer edge and a first appendage located at an extremity of said lamina perpendicular to said longer edge and terminating in a tooth, and wherein said setting means comprises: a releasing frame movable by said wing of each of said setting elements when each of said associated keys is depressed, a common setting member having a bar for cooperating with said tooth for positioning said selected setting element, a setting spring for moving said common setting member together with said selected setting element and releasing means for arresting said common setting member in an inoperative position against the action of said setting means and operable by said releasable frame for releasing said common setting member for the cooperation of said bar with said selected setting element.

17. A keyboard as defined in claim 15, wherein each lamina comprises third and fourth edges on a projection opposite to said first edge; said third edge having a first portion substantially parallel to said second edge forwardly thereto and a second portion, inclined with respect to said second edge and adjacent thereto; so that, when said projection is actuated in said depressed position, the second portion of said third edge slides over said arrest element until the first portion of said third edge is arrested by said arrest element against the action of said spring means, and for causing said projection to locate said fourth edge rearwardly of the first surface of said one corresponding of said series of members for engagement with said first surface upon the forward movement of said lamina.

18. A keyboard as defined in claim 15, further comprising a series of blocking members associated with said series of setting elements and wherein each lamina comprises an appendage engageable with two contiguous blocking members, said blocking members being movably supported along a movement axis substantially perpendicular to the movement plane of said setting elements, leaving a gap therebetween for allowing the setting of one of said setting elements and for stopping two selected of setting elements in a predetermined position between said rest position and set position thereby preventing the simultaneous positioning of two selected of said setting elements, when two keys are simultaneously depressed.

19. A keyboard as defined in claim 18, further comprising unblocking means and a reloading bar operated by said unblocking means and cooperative with said appendage to return to rest said two selected setting elements against the action of said spring means when said two setting elements are arrested in said intermediate position.

20. A keyboard as defined in claim 19 further comprising a switching member manually settable between an on position and an off position, and a blocking element connecting said reloading bar with said switching member for causing said reloading bar to block the appendage of said setting elements in the rest position of said setting elements to prevent setting of said setting elements when the switching member is in said off position.

21. A keyboard for printing machines comprising a series of depressable keys; a series of setting elements assocaited to said keys and each selectable by one corresponding of said keys; a group of code-bars each one movable between a rest position to an active position according to different coded positions by each of said setting elements upon depression of one associated of said keys, each of said coded position of said bars being corresponding to said depressed key; means for restoring said setting elements and said code-bars after the positioning thereof; and memory means for enabling said restoring means to rapidly restore said setting elements and said code-bars to said rest position, memorizing the first or the second position of each of said code-bars said memory means comprising:

a group of decoding bars associated with said code-bars, each of said code-bars and said decoding bars including an arrest element and a counter-arrest element, respectively;

spring means interconnecting said decoding bars with said code-bars holding each of said counter-arrest elements against the arrest element of the associated code-bars, for causing each one of said code-bars to position one associated of said decoding bars from a rest location in a first or in a second location corresponding to the first or the second position of the one associated of said code bars, a positioning member actuatable for arresting each of said decoding bars in said first or second location thereof;

driving means operable through a cycle for actuating said positioning member upon positioning of said code-bars at the beginning of said cycle;

means connecting said driving means with said restoring means for enabling said restoring means to restore said setting element and said code-bars immediately after the positioning thereof against the action of said spring means, leaving said decoding bars arrested by said positioning member said first or in said second location, respectively, until arresting of said setting element and said code-bars in the rest positions thereof; and means for deactivating said positioning member for causing said spring means to shift said decoding bars from said first or second location to said rest location at the end of said cycle.

22. A keyboard as defined in claim 21, further comprising a common setting member; a setting spring for moving said common setting member from a rest position to an operative position together with the selected setting element for positioning said code bars in said coded positions; wherein said driving means comprise a starting clutch having a driving part, a driven part and a releasing member actuatable for connecting, during said cycle, said driven part to said driving part, said releasing member being actuatable by said common setting member, wherein said connecting means comprise a first cam connected with said driven part for operating said common setting member from said operative position to said rest position and wherein said restoring means comprise a second cam also connected with said driven part for operating said positioning member.

23. A keyboard as defined by claim 22, wherein said code-bars are movable along a predetermined trajectory, further comprising a group of springs for pulling said code-bars along said predetermined trajectory, and a bridge means for controlling said code-bars against the action of said group of springs, one selected setting element being set on the predetermined trajectory of said code-bars by said common setting member for selectively arresting same of said code-bars against the action of said group of springs according to the coded positions of the depressed key, the driven part of said starting clutch further controlling said bridge means.

24. A keyboard for office machines comprising: a frame, a series of keys each one movable in said frame from a rest position to a working position; a group of code-bars movable along a predetermined trajectory; a bridge for controlling said code-bars against the action of said group of springs; driving means actuatable by each key, in the working position thereof, for moving in a setting cycle said bridge from a rest position, in which said bridge holds at rest said code-bars against the action of said spring to an operative position in which said bridge releases said code-bars from said operative position to said rest position; a series of setting elements individually selectable from a rest position by one associated key of said keys, in the working position thereof; an actuatable setting member; means for actuating said setting member in said setting cycle from an inoperative position to an operative position and for engaging one selected of said setting elements to move said one selected of said setting elements to a set position located on the trajectory of said code-bars; means supporting said setting elements for causing one set element of said setting elements to arrest some of said code-bars released by said bridge according to code positions corresponding to said one associated key moved in said working position; said arrested code-bars urging said set element against said supporting means; a series of return springs for pulling said set setting element toward said rest position; means for returning said setting member from said operative position toward said inoperative position thereby releasing said set element, the frictional engagement of said some arrested code-bars with said set setting element and against said supporting means caused by said springs prevailing over the action of said return springs over said set element, so that the return of said set element toward said rest position begins only upon the returning of said code-bars to the rest position by said return means; and means for enabling said return springs to free the set element from said some code-bars before the return to rest of said code-bars, whereby speeding up the return of said set setting element, said means comprising a pawl means; arrest means carried by said code-bars for cooperating with said pawl means in each of said code positions, and means controlled by said driving means for moving said pawl means to interfere with said arrest means for temporarily shifting said code-bars towards said rest position, against the action of said springs whereby removing the code-bars arrested by the set setting element from said set element.

* * * * *